· United States Patent [19]
Hadjis

[11] Patent Number: 4,726,790
[45] Date of Patent: Feb. 23, 1988

[54] MULTI-PIN ELECTRICAL CONNECTOR INCLUDING ANTI-RESONANT PLANAR CAPACITORS

[76] Inventor: George C. Hadjis, 28009 Monteveina Dr., San Pedro, Calif. 90732

[21] Appl. No.: 784,265

[22] Filed: Oct. 4, 1985

[51] Int. Cl.[4] ..... H01R 13/66
[52] U.S. Cl. ..... 439/620; 333/185
[58] Field of Search ..... 339/141 R, 143 R; 333/181, 183, 189, 185; 439/92, 610, 620

[56] References Cited

U.S. PATENT DOCUMENTS 4,500,159 2/1985 Briones et al. ..... 339/147 R

*Primary Examiner*—Eugene F. Desmond
*Attorney, Agent, or Firm*—Charles H. Schwartz; Ellsworth R. Roston

[57] ABSTRACT

A multi-pin connector incorporating an anti-resonant planar capacitor for coupling to an external connector having a particular pin configuration, including a first connector portion having a particular pin configuration to mate with the external connector. A second connector portion is interconnected to the first connector portion and with the second connector portion including a plurality of pins interconnected individually to individual ones of the pins of the first connector portion. A plate member is located adjacent to and spaced from the second connector portion and with the plate member supporting a plurality of individual planar capacitors. Each capacitor is connected between one of the pins of the second connector portion and ground, and each planar capacitor is formed by a pair of electrically interconnected ground planes sandwiching a central capacitor area.

63 Claims, 11 Drawing Figures 10
18
20
26
28
30
32
34
36
38
40
42
44
46
48
50
52
54
56
58
60
62
64

MULTI-PIN ELECTRICAL CONNECTOR INCLUDING ANTI-RESONANT PLANAR CAPACITORS

BACKGROUND OF THE INVENTION

1. Field of the Invention

The present invention relates to a multi-pin electrical connector including anti-resonant planar capacitors. Specifically, the present invention is directed to an electrical connector including high voltage capacitors for bypassing any unwanted signals such as high frequency transients from any of the individual pins of the connector to ground, while allowing the passage of wanted signals through the individual pins of the connector.

2. Description of the Prior Art

In the electrical and electronics fields it is often desirable to couple together various pieces of equipment using cables including connectors attached to the ends of the cables. For example, such interconnecting cables and connectors are used in the telephone field such as for interconnecting various pieces of PBX equipment. Also, such cables and connectors are used in the computer field again for interconnecting various pieces of equipment such as the connection of peripherals to computers. In general, it is desirable for any transient signals such as high frequency transients to be eliminated from the interconnecting cables and connectors. This insures that such transient signals are not passed through the connectors to thereby affect the operation of the equipment.

In order to eliminate such transient signals, various types of filters have been used in the prior art. Specifically, it is desirable to provide filters at the input/output "I/O" connections for equipment used in the telecommunication and computer industry and specifically to provide the filters at the connectors which interconnect with the cables which provide electrical connection between various pieces of equipment. In order for these filters to operate properly, the filters should (1) be individually coupled to each pin in the I/O connector, (2) should have sufficient capacitance to bypass the unwanted signals and (3) should have sufficient voltage capability to not break down and thereby short out the pin. Prior art filters for I/O connectors in the telecommunication and computer industry have been lacking in one or more of the above characteristics. Specifically, these filters would not have sufficient high voltage capability and would thereby break down and/or the filters would not have sufficient capacitance to bypass all of the unwanted signals. Other difficulties with the prior art filters are that they were often cumbersome in construction and were thereby difficult to incorporate into existing I/O connectors.

SUMMARY OF THE INVENTION

The present invention is directed to a multi-pin connector which may be used as an I/O connnector in the telecommunication and/or computer industry and with the connector incorporating an integral anti-resonant, high voltage capacitor to filter out undesired transient signals. The anti-resonant, high voltage capacitor of the present invention is formed with a planar configuration to maximize the capacitance while minimizing the physical size of the capacitor. Also, the specific planar configuration is designed to be incorporated directly within the multi-pin structure of the connector and produce a capacitance between each pin in the multi-pin structure and ground. The anti-resonant capacitor of the present invention may be formed either as a plurality of individual capacitors coupled between each pin and ground or may be formed as a plurality of such individual capacitors provided relative to a common ground plane using a unitary substrate and with the entire substrate incorporated within the connector structure to provide for the individual coupling between each pin and ground.

The specific design for the anti-resonant capacitor of the present invention incorporates the use of at least two ground planes sandwiching at least one center capacitance area for each one of the individual capacitors. The present invention may use any combination of a particular number of ground planes sandwiching that particular number less one for the center capacitance areas. The separate ground planes are electrically connected so that two parallel capacitors are formed by each capacitance area relative to the separate ground planes. This structure has the effect of doubling the capacitance value that could be accomplished with a similar structure having a single ground plane and with the resultant capacitor also having the effect of doubling the dielectric thickness relative to a capacitor having the same capacitance value formed with a single ground plane.

This increase in capacitance, while at the same time effectively doubling the dielectric thickness, thereby increases the AC and DC voltages that the capacitor can withstand without breaking down. More importantly, the use of the two ground planes sandwiching a central capacitance area provides for the piezoelectric effects within the dielectric layer to be effectively cancelled. These piezoelectric effects would normally tend to bend the fragile substrate in an AC field and would tend to crack the substrate and result in a short circuit. The effective doubling of the dielectric layer also tends to increase the voltage to which the capacitor will withstand, since the thicker the dielectric layer the greater the voltage before breakdown. The breakdown of the dielectric layer would result in a short circuit.

The anti-resonant capacitor of the present invention may be incorporated within a multi-pin connector using an integral capacitor carrier substrate which may be part of a sandwich construction for the connector. Specifically, output pins from the connector may be coupled to a printed circuit board which may include printed circuit connections to produce a different pin configuration than the output pins from the connector. The substrate carrying the capacitors may then be positioned adjacent this printed circuit board and with pin members passing through the substrate to be received in the printed circuit board to thereby provide for integral pin connectors which are coupled to the capacitor and are coupled through the printed circuit board to the connector.

In place of the substrate receiving and supporting a plurality of individual anti-resonant capacitors, the substrate may itself be formed as a plurality of anti-resonant capacitors. Specifically, the substrate may be formed by a number of layers and with the layers forming the two ground planes sandwiching a plurality of individual central capacitance areas, each one individual to a connector pin. Again, pin members may pass through the substrate to interconnect the capacitances to the connector through a printed circuit board.

BRIEF DESCRIPTION OF THE DRAWINGS

A clearer understanding of the invention may be had with response to the following description and drawings wherein.

DESCRIPTION OF THE PREFERRED EMBODIMENTS

Figure 1:
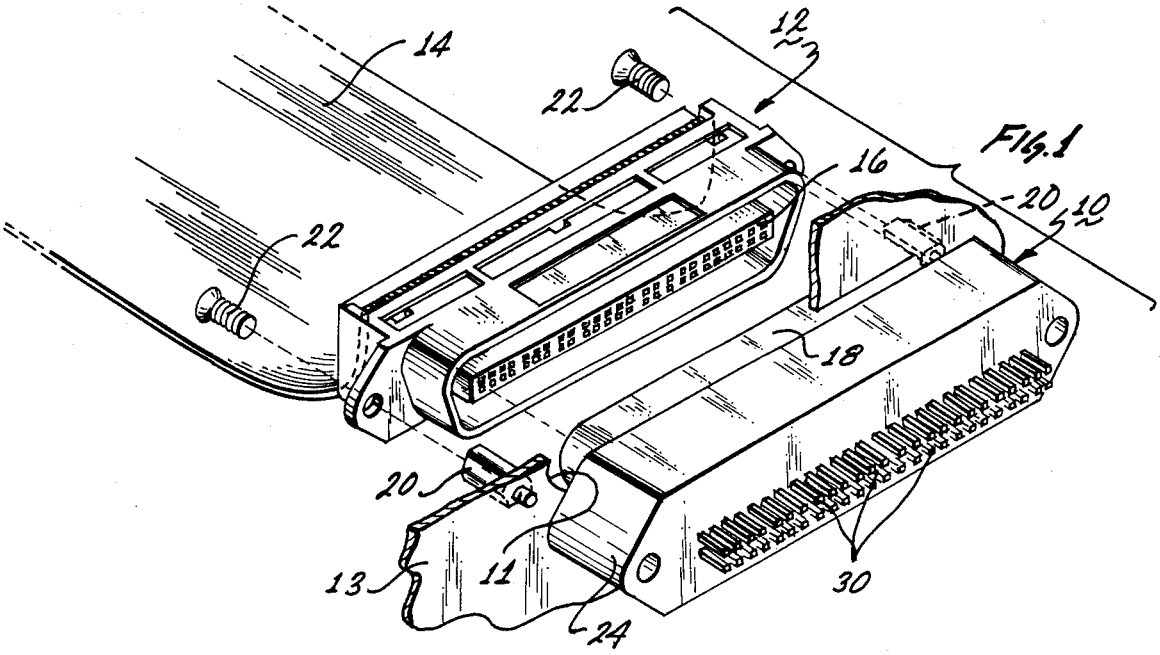
FIG. 1 illustrates a perspective view of a multi-pin connector of the present invention in association with a cable connector assembly.
Figure 3:
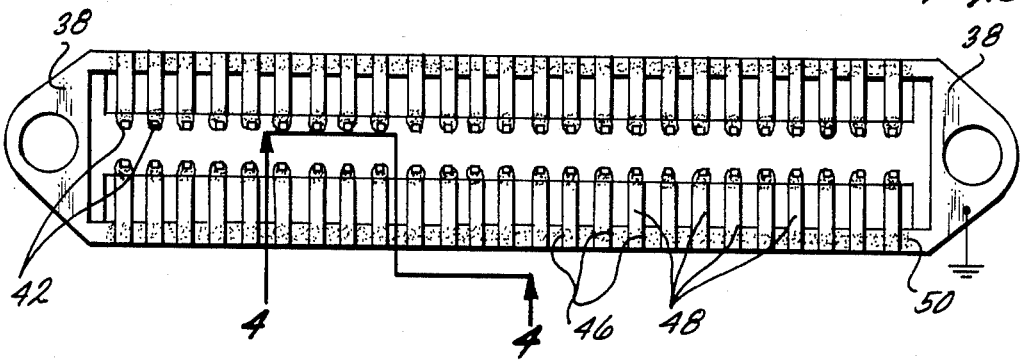
FIG. 3 is a top view of a substrate carrying a plurality of anti-resonant capacitors of the present invention.
Figure 4:
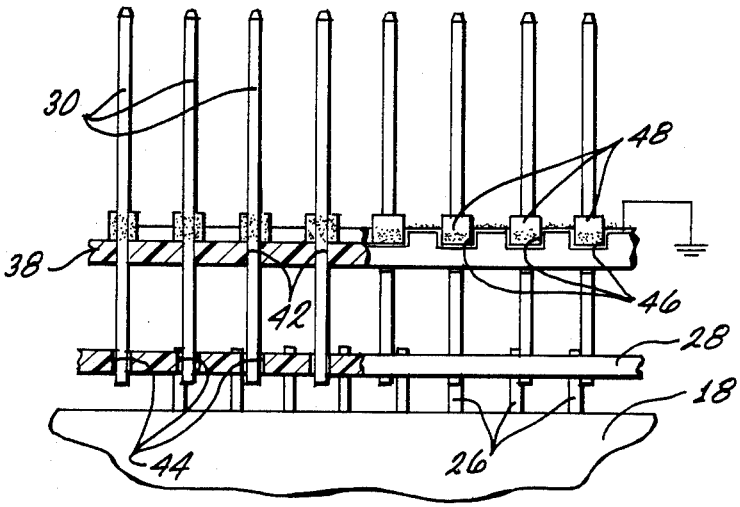
FIG. 4 is a cross-sectional view taken along lines 4—4 of FIG. 3.

FIGS. 1 through 6 illustrate a first embodiment of a multi-pin connector assembly 10 incorporating anti-resonant planar capacitors of the present invention. The connector assembly 10 is shown positioned to extend through an opening 11 in a wall portion 13 of a piece of equipment. The connector assembly is designed to receive a complimentary connector 12 attached to a multi-wire ribbon cable 14. The connector 12 is shown to be a male connector, including a plug section 16 to be received within a complimentary connector 18 of the connector assembly 10. The connector assembly 10 is mounted to have the portion 18 extend through the opening 11 using mounting bolts 20. The mounting bolts 20 also include a threaded nut portion to receive bolt members 22 to lock the connector 12 to the connector 18 of the connector assembly 10. As shown in FIG. 1 the connector assembly 10 is mounted on the equipment to have the connector portion 18 protrude from the opening 11 in a wall portion 13 of the equipment and with the remaining portion of the connector assembly which is covered by a shield member 24 located within the equipment.

Figures 2, 5A, 5B:
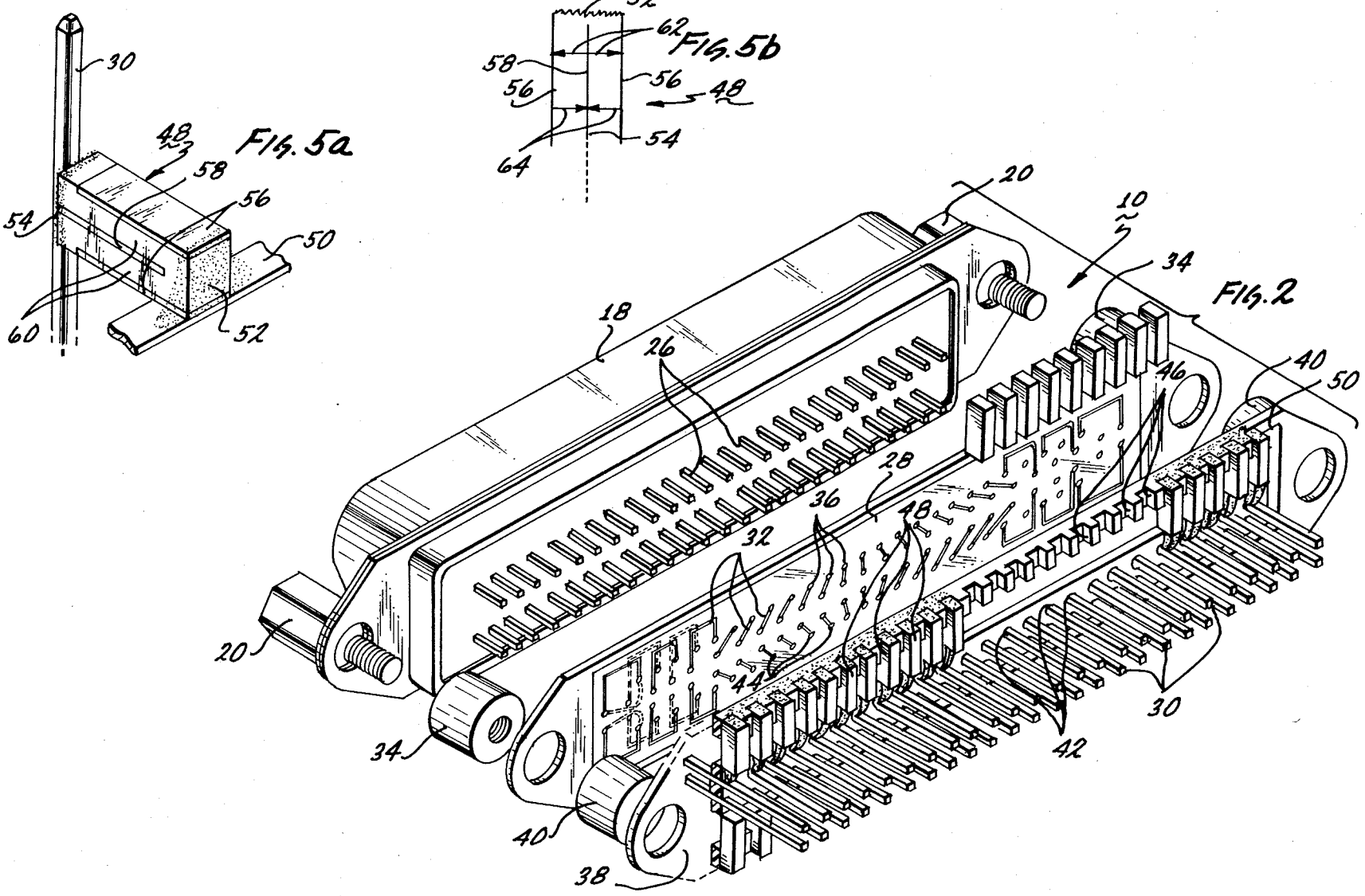
FIG. 2 is an exploded view of a first embodiment of the multi-pin connector of the present invention.
FIG. 5*a* is a detail view of an individual anti-resonant capacitor of the present invention.
FIG. 5*b* is an electrical equivalent of the anti-resonant capacitor of the present invention.
Figure 6:
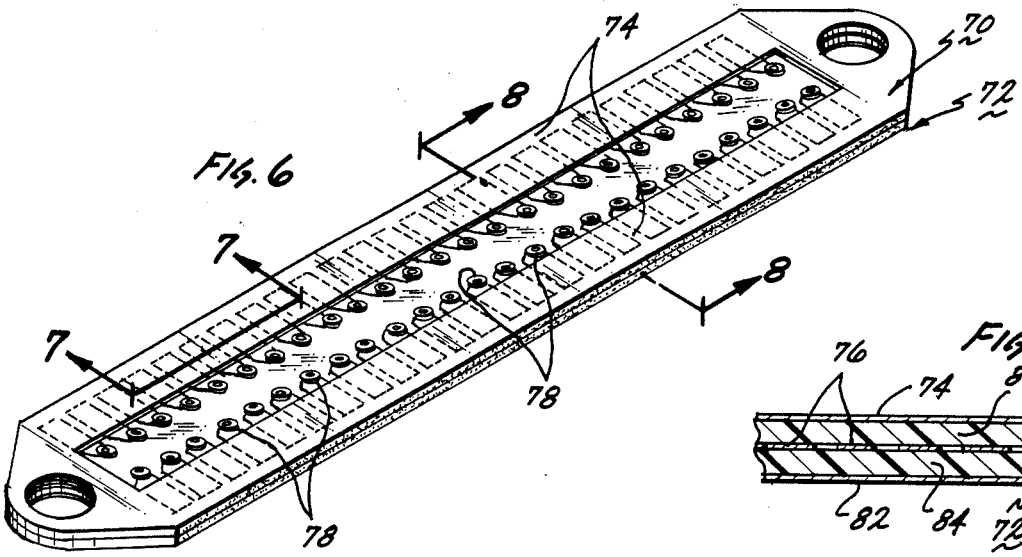
FIG. 6 is a perspective view of a second embodiment of the anti-resonant capacitor incorporated in the connector of the present invention.
Figure 7:
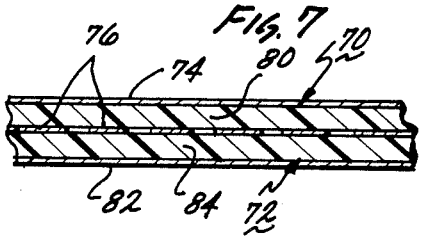
FIG. 7 is a cross-sectional view taken along lines 7—7 of FIG. 6.
Figure 8:
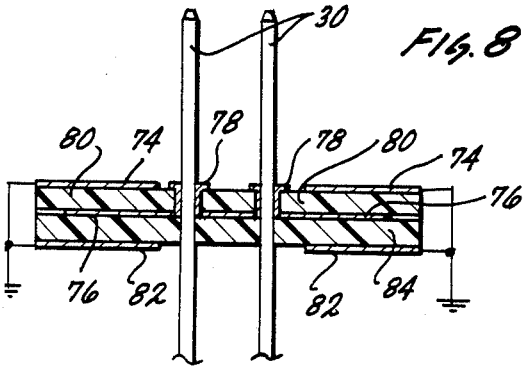
FIG. 8 is a cross-section view taken along lines 8—8 of FIG. 6.
Figure 9:
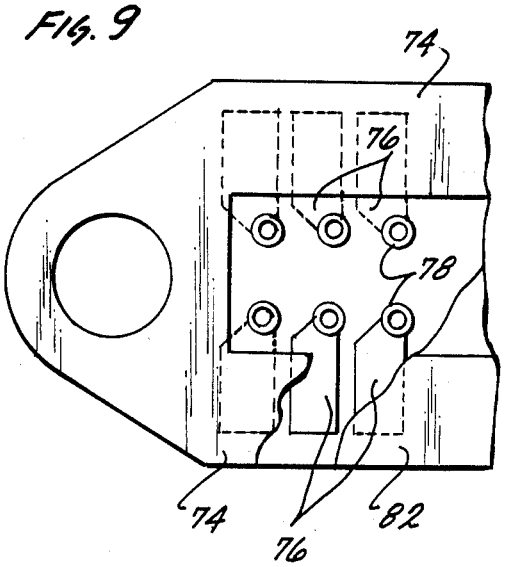
FIG. 9 is a top detail view of the structure of FIG. 6.

FIG. 2 illustrates the connector assembly 10 in an exploded form and with the shield member 24 removed. The connector 18 is of a standard type to mate with the connector 12 and includes a plurality of pin members 26 extending from the connector 18. As an example, the pin members 26 would be normally mounted into a printed circuit board to provide for connection to external portions of a piece of equipment. The present invention also has the pin members mounted into a printed circuit board 28, but with such printed circuit board serving a different purpose. Specifically, the printed circuit board 28 is used to interconnect the pin configuration of the pins 26 to a different pin configuration for a different type of connector. This different pin configuration is shown by the pins 30 and the printed circuit board 28 includes a plurality of printed circuit wires 32 to provide for the interconnection between the group of pins 26 and the group of pins 30, each group having different pin configurations.

The printed circuit board 28 is mounted to and spaced from the connector 18, using spacers 34. The spacers 34 provide for the board being a specific distance from the connector 18 so that the pins 26 are received within first openings 36 at one end of the printed circuit wires 32. Once the pins 26 are received within the openings 36, then a second printed circuit board 38 may be positioned above the printed circuit board 28 using a second group of spacers 40. The second printed circuit board 38 includes a plurality of openings 42 to receive the pins 30 and with the pins 30 extending through the openings 42 to be received by a second group of openings 44 at the other end of the printed circuit wires 32. It can be seen therefore, that the pins 30 are interconnected to the pins 26 using the printed circuit board 28.

The printed circuit board 38 may also include a plurality of recesses 46, which recesses are designed to receive and support individual anti-resonant planar capacitors 48. The printed circuit board 38 includes an outer perimeter of conductive material 50 so that one end of all of the capacitors 48 are connected together. The other end of each of the capacitors 48 are individually connected to one of the pins 30. The various components may be electrically connected using dip soldering so that the perimeter portion 50 through the various spacer members 34 and 40 becomes connected to the outer shell of the connector 18 and thereby to the body of the equipment. In this way the outer perimeter 50 and one end of all of the individual capacitors 48 are connected to ground. The other end of all of the individual capacitors are individually coupled to the pins 30 and via the printed circuit board 28 to the pins 26. Therefore, each individual pin connection to the connector 18 and thereby to the complimentary connector 12 is coupled to an individual capacitor to ground.

FIG. 5*a* illustrates in detail one of the capacitors 48 and shows the capacitor coupled at one end to the pin 30 and at the other end to the perimeter portion 50 of the printed circuit board 38. FIG. 5*a* also illustrates a slight modification in that the printed circuit board 38 need not always include the slots 46, but the capacitor 40 may be directly attached to the perimeter portion 50 formed as a flat surface. In either event, the capacitor is attached at both ends by soldering, as shown by solder connection 52 at one end of the capacitor and solder connection 54 at the other end of the capacitor. Similarly, as described above, the pins 30 and 26 would be soldered within the openings 36 and 44 in the printed circuit board 28.

As shown in FIG. 5*a*, each individual capacitor 48 is formed of a pair of ground planes 56 sandwiching a central conductive area 58 and with the ground planes separated from the central conductive area by dielectric material 60. As an example, the dielectric material may be barium titanate. The electrical equivalent for the three or odd plane capacitor 48 is shown in FIG. 5*b*. The outside ground planes 56 are coupled together through the solder material 52 and with the central conductive area 58 sandwiched between the outer ground planes. The particular structure for the three plane capacitor 48 has a number of important advantages over prior art planar capacitors. First, the use of the two ground planes sandwiching the central area effectively doubles the value of capacitance relative to a two plane capacitor formed from one capacitor area spaced from a single ground plane. This is because the central conductive area 58 forms a capacitor with each of the ground planes 56 so as to provide for two capacitors in parallel with each other, thereby nominally doubling the effective capacitance.

If a two plane capacitor were formed from a conductive area spaced from a single ground plane and having a size to provide an effective capacitance equal to the capacitance of capacitor 48, and with the spacing between these two conductive areas equal to the spacing between the central area 58 and either of the ground planes 56, this would result of a breakdown potential for such a two plane capacitor of a particular value. Since the three plane capacitor of the present invention provides for a total capacitance formed by two parallel capacitors, this means that each parallel capacitors has a lower capacitance value and therefore exhibits a higher breakdown potential for the same thickness dielectric. The three plane capacitor 48 of the present invention therefore effectively doubles the capacitance thickness and therefore doubles the breakdown voltage relative to a two plane capacitor of the same capacitance value.

Another important advantage of the three plane capacitor of the present invention is that the piezoelectric phenomenon virtually is eliminated with the structure of the capacitor of the present invention. This piezoelectric phenomenon could result in a short circuit of the capacitor since the piezo electric phenomenon produces bending of the substrate in an AC field to thereby cause cracks in the substrate which can ultimately result in a short circuit. In the structure of the three plane capacitor of the present invention, each bending effect produces an equal and opposite reaction, as shown by the arrows 62 and 64 at different positions along the capacitor. The forces produced by the piezoelectric effect thereby cancel each other so as to substantially eliminate any damage to the substrate even under the influence of relatively high AC voltages. The structure of the capacitor of the present invention therefore provides for an anti-resonant effect to eliminate this potential breakdown of the capacitor. The capacitor thereby provides in a very small space a relatively high capacitance and a relatively high breakdown voltage relative to prior art capacitors.

FIGS.6 through 10 illustrate a second embodiment of the invention wherein the multiple capacitors are formed integrally, using a plurality of printed circuit plate members. As shown in FIGS. 6 through 9, the capacitor structure may be formed by two plate members 70 and 72. The first plate member 70 has printed on one side the first ground plane 74, which ground plane is subdivided into two portions extending around the perimeter of the plate 70. The other side of the plate member 70 includes a plurality of separate conductive areas 76. These conductive areas will form the center area in the individual capacitors. A plurality of plated through holes 78 spaced from the ground plane 74 extend through the plate member from one side to the other and provide for a connection to the conductive areas 76. The conductive areas and ground plane are spaced from each other by dielectric material 80. The second plate member 72 is formed with a conductive area 82 which is similar to the conductive area 74 and with this conductive area formed on a dielectric material 84. It can be seen therefore that the central conductive areas 76 and sandwiched between the conductive areas 74 and 82 forming the ground planes.

The ground planes 74 and 82 are coupled together and then connected to ground and with the pin members 30 passing through and being connected to the central conductive areas 76 through the plated through holes 78. It can be seen therefore that all of the individual capacitors 48 shown in FIGS. 1 through 5 may be accomplished using the structure shown in FIGS. 6 through 9 and with these capacitors formed using printed circuit techniques to alleviate the necessity for individually coupling separate capacitors to each pin member.

In addition, the structure shown in FIGS. 6 through 9 provides for the same advantages as the individual capacitors shown in FIGS. 1 through 5 in having the capacitors formed by a pair of ground planes sandwiching a central area and with the ground planes electrically connected together so that two parallel connectors are formed by each central area. This produces the advantages of the piezoelectric effects cancelling each other and also provides for the effective dielectric thickness being doubled for a particular capacitance value.

Figure 10:
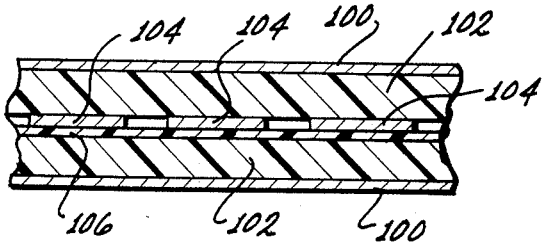
FIG. 10 is a modification of the embodiment of FIG. 6.

FIG. 10 illustrates a modification of the structure shown in FIGS. 6 through 9. In FIG. 10, individual ground planes 100 are formed on individual dielectric layers 102. Both ground planes may have the same design so as to eliminate the necessity for additional designs for the printed circuit structure for the ground planes. A central capacitance area is formed by a plurality of central areas 104 being deposited on a thin film 106 and with the thin film and conductive areas 104 being captured between the conductive ground planes 100. The configuration of the various plate members shown in FIG. 10 may be similar to that shown in FIGS. 6 through 9 so as to provide for the plurality of individual capacitors having the advantages described in the present invention.

The present invention therefore provides for a multipin connector incorporating a plurality of anti-resonant high voltage planar capacitors and with the connector provided by a plurality of layers of printed circuits sandwiched and spaced from each other and from a connector portion. A first printed circuit layer provides for an interrelationship between a particular pin configuration of the connector portion and a different pin configuration and with a second layer supporting the second pin configuration and additionally supporting a plurality of individual anti-resonant planar capacitors to provide for a bypass filter to filter out any unwanted transients on the individual pins. It is to be appreciated that the first printed circuit layer may be eliminated and with the anti-resonant capacitors directly coupled to the connector to similarly provide for the bypass filters for the individual pins of the connector. It is also to be appreciated that the capacitors may be formed as completely individual capacitors and positioned independently to each other to interconnect to the individual pins of the connector or the capacitors may be formed in a unitary fashion to provide for a plurality of individual capacitors each interrelated to a specific pin of the connector.

Although the invention has been described with reference to particular embodiments, it is to be appreciated that various adaptations and modifications may be made and the invention is only to be limited by the appended claims.

We claim:

1. A multi-pin connector incorporating an anti-resonant planar high voltage capacitor for coupling to an external connector having a particular pin configuration, including a first connector portion having a particular pin configuration to mate with the external connector, a second connector portion interconnected to the first connector portion and with the second connector portion including a plurality of pins interconnected individually to individual ones of the pins of the first connector portion, a plate member located adjacent to and spaced from the second connector portion and with the plate member supporting a plurality of individual planar capacitors and with each capacitor connected between one of the pins of the second connector portion and ground, each planar capacitor formed by a pair of electrically interconnected ground planes sandwiching a central capacitor area, and a printed circuit board intermediate the second connector portion and the plate member and with the printed circuit board including a plurality of printed circuit wires providing for the individual connection between individual ones of the pins of the second connector portion and individual ones of the planar capacitors.

2. The multi-pin connector of claim 1 wherein the second connector portion has the same pin configuration as the first connector portion.

3. The multi-pin connector of claim 1 wherein the second connector portion has a different pin configuration from the first connector portion.

4. The multi-pin connector of claim 1 wherein the plate member includes a plurality of slots and with each slot having dimensions to receive and support an individual one of the planar capacitors.

5. The multi-pin connector of claim 1 wherein the printed circuit board includes a plurality of first openings corresponding to and receiving the plurality of pins of the second connector portion and with one end of each of the printed circuit wires terminating at each of the first openings.

6. The multi-pin connector of claim 5 additionally including a further plurality of pins each connected to one of the planar capacitors and wherein the printed circuit board includes a plurality of second openings corresponding to and receiving the further plurality of pins and with the other end of each of the printed circuit wires terminating at each of the second openings.

7. An anti-resonant planar capacitor structure for incorporation in a multi-pin connector and with the connector including a first connector portion having a particular pin configuration and a second connector portion interconnected to the first connector portion and with the second connector portion including a plurality of pins interconnected individually to individual ones of the pins of the first connector portion, the capacitor structure including a plate member located adjacent to and spaced from the second connector portion and with the plate member supporting a plurality of individual planar capacitors and with each capacitor connected between one of the pins of the second connector portion and ground, each planar capacitor formed by a pair of electrically interconnected ground planes sandwiching a central capacitor area, and a printed circuit board intermediate the second connector portion and the plate member and with the printed circuit board including a plurality of printed circuit wires providing for the individual connection between individual ones of the pins of the second connector portion and individual ones of the planar capacitors.

8. The capacitor structure of claim 7 wherein the plate member includes a plurality of slots and with each slot having dimensions to receive and support an individual one of the planar capacitors.

9. The capacitor structure of claim 7 wherein the printed circuit board includes a plurality of first openings corresponding to and receiving the plurality of pins of the second connector portion and with one end of each of the printed circuit wires terminating at each of the first openings.

10. The capacitor structure of claim 9 additionally including a further plurality of pins each connected to one of the planar capacitors and wherein the printed circuit board includes a plurality of second openings corresponding to and receiving the further plurality of pins and with the other end of each of the printed circuit wires terminating at each of the second openings.

11. An anti-resonant planar capacitor structure for coupling to an electrical component having a particular electrical pin configuration, including a plate member located adjacent to and spaced from the electrical component and with the plate member supporting a plurality of individual planar capacitors and with each capacitor connected between one of the pins of the electrical component and ground, each planar capacitor formed by a pair of electrically interconnected ground planes sandwiching a central capacitor area, and a printed circuit board intermediate the electrical component and the plate member and with the printed circuit board including a plurality of printed circuit wires providing for the individual connection between individual ones of the pins of the electrical component and individual ones of the planar capacitors.

12. The capacitor structure of claim 11 wherein the plate member includes a plurality of slots and with each slot having dimensions to receive and support an individual one of the planar capacitors.

13. The capacitor structure of claim 11 wherein the printed circuit board includes a plurality of first openings corresponding to and receiving the plurality of pins of the electrical component and with one end of each of the printed circuit wires terminating at each of the first openings.

14. The capacitor structure of claim 13 additionally including a further plurality of pins each connected to one of the planar capacitors and wherein the printed circuit board includes a plurality of second openings corresponding to and receiving the further plurality of pins and with the other end of each of the printed circuit wires terminating at each of the second openings.

15. A multi-pin connector incorporating an anti-resonant planar high voltage capacitor for coupling to an external connector having a particular pin configuration, including a first connector portion having a particular pin configuration to mate with the external connector, a second connector portion interconnected to the first connector portion and with the second connector portion including a plurality of pins interconnected individually to individual ones of the pins of the first connector portion, a plate member located adjacent to and spaced from the second connector portion and with the plate member supporting a plurality of individual planar capacitors and with each capacitor connected between one of the pins of the second connector portion and ground, the plate member also including a printed circuit wire extending around the perimeter of the plate member and adjacent one end of the each capcitor for providing a common electrical connection to one end of all the capacitors, and each planar capacitor formed by a pair of electrically interconnected ground planes sandwiching a central capacitor area.

16. The multi-pin connector of claim 15 wherein the second connector portion has the same pin configuration as the first connector portion.

17. The multi-pin connector of claim 15 wherein the second connector portion has a different pin configuration from the first connector portion.

18. The multi-pin connector of claim 15 wherein the plate member includes a plurality of slots and with each slot having dimensions to receive and support an individual one of the planar capacitors.

19. The multi-pin connector of claim 15 additionally including a printed circuit board intermediate the second connector portion and the plate member and with the printed circuit board including a plurality of printed circuit wires providing for the individual connection between individual ones of the pins of the second connector portion and individual ones of the planar capacitors.

20. The multi-pin connector of claim 19 wherein the printed circuit board includes a plurality of first openings corresponding to and receiving the plurality of pins of the second connector portion and with one end of each of the printed circuit wires terminating at each of the first openings.

21. The multi-pin connector of claim 20 additionally including a further plurality of pins each connected to one of the planar capacitors and wherein the printed circuit board includes a plurality of second openings corresponding to and receiving the further plurality of pins and with the other end of each of the printed circuit wires terminating at each of the second openings.

22. The multi-pin connector of claim 15 wherein the plate member is formed by a plurality of layers of dielectric material supporting three conductive layers in the sandwich arrangement and with the outside layers electrically connected and forming the ground planes and with the central layer formed as a plurality of discrete conductive areas each of which forms an individually capacitor area relative to the ground planes.

23. The multi-pin connector of claim 22 wherein the plurality of dielectric layers are two in number and with one dielectric layer having one ground plane on one side and discrete conductive areas on the other side and with the other dielectric layer having one side positioned adjacent the discrete conductive areas and having the other ground plane on the other side.

24. The multi-pin connector of claim 22 wherein the plurality of dielectric layers are three in number and with two of the dielectric layers each supporting one of the ground planes and the third dielectric layer supporting the discrete conductive areas.

25. An anti-resonant planar capacitor structure for incorporation in a multi-pin connector and with the connector including a first connector portion having a particular pin configuration and a second connector portion interconnected to the first connector portion and with the second connector portion including a plurality of pins interconnected individually to individual ones of the pins of the first connector portion, the capacitor structure including a plate member located adjacent to and spaced from the second connector portion and with the plate member supporting a plurality of individual planar capacitors and with each capacitor connected between one of the pins of the second connector portion and ground, the plate member also including a printed circuit wire extending around the perimeter of the plate number and adjacent one end of each capacitor for providing a common electrical connection to one end of all of the capacitors, and each planar capacitor formed by a pair of electrically interconnected ground planes sandwiching a central capacitor area.

26. The capacitor structure of claim 25 additionally including a printed circuit board intermediate the second connector portion and the plate member and with the printed circuit board including a plurality of printed circuit wires providing for the individual connection between individual ones of the pins of the second connector portion and individual ones of the planar capacitors.

27. The capacitor structure of claim 26 wherein the printed circuit board includes a plurality of first openings corresponding to and receiving the plurality of pins of the second connector portion and with one end of each of the printed circuit wires terminating at each of the first openings.

28. The capacitor structure of claim 27 additionally including a further plurality of pins each connected to one of the planar capacitors and wherein the printed circuit board includes a plurality of second openings corresponding to and receiving the further plurality of pins and with the other end of each of the printed circuit wires terminating at each of the second openings.

29. The capacitor structure of claim 25 wherein the plate member includes a plurality of slots and with each slot having dimensions to receive and support an individual one of the planar capacitors.

30. The capacitor structure of claim 25 wherein the plate member is formed by a plurality of layers of dielectric material supporting three conductive layers in the sandwich arrangement and with the outside layers electrically connected and forming the ground planes and with the central layer formed as a plurality of discrete conductive areas each of which forms an individually capacitor area relative to the ground planes.

31. The capacitor structure of claim 30 wherein the plurality of dielectric layers are two in number and with one dielectric layer having one ground plane on one side and discrete conductive areas on the other side and with the other dielectric layer having one side positioned adjacent the discrete conductive areas and having the other ground plane on the other side.

32. The capacitor structure of claim 30 wherein the plurality of dielectric layers are three in number and with two of the dielectric layers each supporting one of the ground planes and the third dielectric layer supporting the discrete conductive areas.

33. An anti-resonant planar capacitor structure for coupling to an electrical component having a particular electrical pin configuration, including a plate member located adjacent to and spaced from the electrical component and with the plate member supporting a plurality of individual planar capacitors and with each capacitor connected between one of the pins of the electrical component and ground, the plate member also including a printed circuit wire extending around the perimeter of the plate number and adjacent one end of each capacitor for providing a common electrical connection to one end of all of the capacitors, and each planar capacitor formed by a pair of electrically interconnected ground planes sandwiching a central capacitor area.

34. The capacitor structure of claim 33 additionally including a printed circuit board intermediate the electrical component and the plate member and with the printed circuit board including a plurality of printed circuit wires providing for the individual connection between individual ones of the pins of the electrical component and individual ones of the planar capacitors.

35. The capacitor structure of claim 34 wherein the printed circuit board includes a plurality of first openings corresponding to and receiving the plurality of pins of the electrical component and with one end of each of the printed circuit wires terminating at each of the first openings.

36. The capacitor structure of claim 35 additionally including a further plurality of pins each connected to one of the planar capacitors and wherein the printed circuit board includes a plurality of second openings corresponding to and receiving the further plurality of pins and with the other end of each of the printed circuit wires terminating at each of the second openings.

37. The capacitor structure of claim 35 wherein the plate member includes a plurality of slots and with each slot having dimensions to receive and support an individual one of the planar capacitors.

38. The capacitor structure of claim 35 wherein the plate member is formed by a plurality of layers of dielectric material supporting three conductive layers in the sandwich arrangement and with the outside layers electrically connected and forming the ground planes and with the central layer formed as a plurality of discrete conductive areas each of which forms an individually capacitor area relative to the ground planes.

39. The capacitor structure of claim 38 wherein the plurality of dielectric layers are two in number and with one dielectric layer having one ground plane on one side and discrete conductive area on the other side and with the other dielectric layer having one side positioned adjacent the discrete conductive areas and having the other ground plane on the other side.

40. The capacitor structure of claim 38 wherein the plurality of dielectric layers are three in number and with two of the dielectric layers each supporting one of the ground planes and the third dielectric layers supporting the discrete conductive areas.

41. The multi-pin connector incorporating an anti-resonant planar high voltage capacitor for coupling to an external connector having a particular pin configuration, including a first connector portion having a particular pin configuration to mate with the external connector, a second connector portion interconnected to the first connector portion and with the second connector portion including a plurality of pins interconnected individually to individual ones of the pins of the first connector portion, a plate member located adjacent to and spaced from the second connector portion and with the plate member supporting a plurality of individual planar capacitors and with each capacitor connected between one of the pins of the second connector portion and ground, each planar capacitor formed by a pair of electrically interconnected ground planes sandwiching a central capacitor area, and the plate member formed by a plurality of layers of dielectric material supporting three conductive layers in the sandwich arrangement and with the outside layers electrically connected and forming the ground planes and with the central layer formed as a plurality of discrete conductive areas each of which forms an individually capacitor area relative to the ground planes.

42. The multi-pin connector of claim 41 wherein the second connector portion has the same pin configuration as the first connector portion.

43. The multi-pin connector of claim 41 wherein the second connector portion has a different pin configuration from the first connector portion.

44. The multi-pin connector of claim 41 wherein the plurality of dielectric layers are two in number and with one dielectric layer having one ground plane on one side and discrete conductive areas on the other side and with the other dielectric layer having one side positioned adjacent the discrete conductive areas and having the other ground plane on the other side.

45. The multi-pin connector of claim 41 wherein the plurality of dielectric layers are three in number and with two of the dielectric layers each supporting one of the ground planes and the third dielectric layer supporting the discrete conductive areas.

46. The multi-pin connector of claim 41 additionally including a printed circuit board intermediate the second connector portion and the plate member and with the printed circuit board including a plurality of printed circuit wires providing for the individual connection between individual ones of the pins of the second connector portion and individual ones of the planar capacitors.

47. The multi-pin connector of claim 46 wherein the printed circuit board includes a plurality of first openings corresponding to and receiving the plurality of pins of the second connector portion and with one end of each of the printed circuit wires terminating at each of the first openings.

48. The multi-pin connector of claim 47 wherein each of the plurality of pins of the first connector portion is connected to one of the planar capacitors and wherein the printed circuit board includes a plurality of second openings corresponding to and receiving the plurality of pins of the first connector portion and with the other end of each of printed circuit wires terminating at each of the second openings.

49. The multi-pin connector of claim 41 wherein the plate member includes a plurality of slots and with each slot having dimensions to receive and support an individual one of the planar capacitors.

50. An anti-resonant planar capacitor structure for incorporation in a multi-pin connector and with the connector including a first connector portion having a particular pin configuration and a second connector portion interconnected to the first connector portion and with the second connector portion including a plurality of pins interconnected individually to individual ones of the pins of the first connector portion, the capacitor structure including a plate member located adjacent to and spaced from the second connector portion and with the plate member supporting a plurality of individual planar capacitors and with each capacitor connected between one of the pins of the second connector portion and ground, each planar capacitor formed by a pair of electrically interconnected ground planes sandwiching a central capacitor area, and the plate member formed by a plurality of layers of dielectric material supporting three conductive layers in the sandwich arrangement and with the outside layers electrically connected and forming the ground planes and with the central layer formed as a plurality of discrete conductive areas each of which forms an individually capacitor area relative to the ground planes.

51. The capacitor structure of claim 50 wherein the plate member includes a plurality of slots and with each slot having dimensions to receive and support an individual one of the planar capacitors.

52. The capacitor structure of claim 50 wherein the plurality of dielectric layers are two in number and with one dielectric layer having one ground plane on one side and discrete conductive areas on the other side and with the other dielectric layer having one side positioned adjacent the discrete conductive areas and having the other ground plane on the other side.

53. The capacitor structure of claim 50 wherein the plurality of dielectric layers are three in number and with two of the dielectric layers each supporting one of the ground planes and the third dielectric layer supporting the discrete conductive areas.

54. The capacitor structure of claim 50 additionally including a printed circuit board intermediate the second connector portion and the plate member and with the printed circuit board including a plurality of printed circuit wires providing for the individual connection between individual ones of the pins of the second connector portion and individual ones of the planar capacitors.

55. The capacitor structure of claim 54 wherein the printed circuit board includes a plurality of first openings corresponding to and receiving the plurality of pins of the second connector portion and with one end of each of the printed circuit wires terminating at each of the first openings.

56. The capacitor structure of claim 55 wherein each of the plurality of pins of the first connector portion is connected to one of the planar capacitors and wherein the printed circuit board includes a plurality of second openings corresponding to and receiving the plurality of pins of the first connector portion and with the other end of each of the printed circuit wires terminating at each of the second openings.

57. An anti-resonant planar capacitor structure for coupling to an electrical component having a particular electrical pin configuration, including a plate member located adjacent to and spaced from the electrical component and with the plate member supporting a plurality of individual planar capacitors and with each capacitor connected between one of the pins of the electrical component and ground, each planar capacitor formed by a pair of electrically interconnected ground planes sandwiching a central capacitor area, and the plate member formed by a plurality of layers of dielectric material supporting three conductive layers in the sandwich arrangement and with the outside layers electrically connected and forming the ground planes and with the central layer formed as a plurality of discrete conductive areas each of which forms an individually capacitor area relative to the ground planes.

58. The capacitor structure of claim 57 wherein the plate member includes a plurality of slots and with each slot having dimensions to receive and support an individual one of the planar capacitors.

59. The capacitor structure of claim 57 wherein the plurality of dielectric layers are two in number and with one dielectric layer having one ground plane on one side and discrete conductive areas on the other side and with the other dielectric layer having one side positioned adjacent the discrete conductive areas and having the other ground plane on the other side.

60. The capacitor structure of claim 57 wherein the plurality of dielectric layers are three in number and with two of the dielectric layers each supporting one of the ground planes and the third dielectric layer supporting the discrete conductive areas.

61. The capacitor structure of claim 57 additionally including a printed circuit board intermediate the electrical component and the plate member and with the printed circuit board including a plurality of printed circuit wires providing for the individual connection between individual ones of the pins of the electrical component and individual ones of the planar capacitors.

62. The capacitor structure of claim 61 wherein the printed circuit board includes a plurality of first openings corresponding to and receiving the plurality of pins of the electrical component and with one end of each of the printed circuit wires terminating at each of the first openings.

63. The capacitor structure of claim 62 additionally including a further plurality of pins each connected to one of the planar capacitors and wherein the printed circuit board includes a plurality of second openings corresponding to and receiving the further plurality of pins and with the other end of each of the printed circuit wires terminating at each of the second openings.

* * * * *